US006280531B1

(12) United States Patent
Galbreath

(10) Patent No.: US 6,280,531 B1
(45) Date of Patent: Aug. 28, 2001

(54) METHOD FOR CLEANING A PAINT ROLLER

(76) Inventor: John Alexander Galbreath, 2516 Chestnut Woods Ct., Reisterstown, MD (US) 21136

( * ) Notice: Subject to any disclaimer, the term of this patent is extended or adjusted under 35 U.S.C. 154(b) by 0 days.

(21) Appl. No.: 09/670,979

(22) Filed: Sep. 27, 2000

Related U.S. Application Data

(63) Continuation of application No. 09/272,705, filed on Mar. 19, 1999, now Pat. No. 6,125,497.

(51) Int. Cl.[7] ..... A47L 13/02; B05C 21/00; B08B 7/00

(52) U.S. Cl. ..... 134/6; 134/25.1; 134/25.5; 134/38; 15/236.03; 15/104.04

(58) Field of Search ..... 134/6, 25.1, 25.5, 134/38; 15/104.04, 236.01, 236.03, 236.05, 236.09

(56) References Cited

U.S. PATENT DOCUMENTS

| | | | |
|---|---|---|---|
| 3,707,740 | 1/1973 | Demers | 15/236 R |
| 3,731,697 | 5/1973 | Yost | 134/138 |
| 4,061,153 | 12/1977 | Doherty | 134/138 |
| 4,287,631 | 9/1981 | Marrs | 15/105 |
| 4,324,018 | 4/1982 | Olsson | 15/236 R |
| 4,606,777 | 8/1986 | Brow | 134/38 |
| 4,982,471 | 1/1991 | Bannan | 15/105 |
| 5,185,938 | 2/1993 | Hutt | 34/58 |
| 5,272,782 | 12/1993 | Hutt | 15/105 |
| 5,335,392 | 8/1994 | Evans | 15/236.03 |
| 5,515,567 | 5/1996 | Washburn | 15/3 |
| 5,546,625 | 8/1996 | Mealey, Sr. | 15/105 |

*Primary Examiner*—Zeinab El-Arini

(57) ABSTRACT

The invention includes a method of cleaning a paint roller. The cleaning tool used in this method includes a flat, disc-shaped main body (10) having cleaning apertures (11*a, b,c,&d*) located thereon. Cleaning apertures (11*a,b,c,&d*) have diameters suitably smaller than the outside diameter, including the nap covering, of various popular roller sizes and nap thicknesses, such that a friction fit between the nap covering of such a roller and a cleaning aperture (11*a,b,c,* or *d*) is provided. Four access notches (12*a,b,c,&d*) extend from the circumference of cleaning apertures (11*a,b,c,&d*) respectively, to the circumference of main body (10). In this method, a cleaning tool is placed over the handle end of a roller, with the wire portion of the handle passing through one of the access notches (12*a,b,c,* or *d*) and into the center of one of the cleaning apertures (11*a,b,c,* or *d*). The cleaning tool is then drawn down over the nap surface of the roller, and the friction fit between the cleaning aperture (11*a,b,c,* or *d*) and the nap surface of the roller acts to wipe paint or solvent from the roller.

20 Claims, 6 Drawing Sheets

METHOD FOR CLEANING A PAINT ROLLER

CROSS-REFERENCES TO RELATED APPLICATIONS

This is a continuation of application Ser. No. 09/272,705, filed Mar. 19, 1999, now U.S. Pat. No. 6,125,497.

BACKGROUND

1. Field of Invention

This invention is in the area of paint equipment cleaning methods, specifically a paint roller cleaning method that uniformly wipes excess paint or solvent from rollers having different diameters and different nap thicknesses, that requires only one pass down the roller to effectively wipe the roller clean, and that can be easily used while the roller is on the roller frame.

2. Discussion of Prior Art

Paint roller cleaning methods are known in the art, and fall into five general categories:

A. Formed-Wire Roller Wipers

Formed-wire roller wipers, shown in U.S. Pat. No. 4,287,631 to Marrs and U.S. Pat. No. 5,335,392 to Evans, have inherent drawbacks, among the largest being that the wire lacks a flange-like surface to retain the paint below the wire as the device is drawn down the roller. Consequently, the wire does not force paint downward off the roller well enough, and excess paint can ride up over the wire as the device is drawn down the roller. Second, the formed wire, because of its round cross section, does not engage the nap surface of the roller squarely, and thus does not provide optimal wiping action. Third, the wire does not surround a large enough portion of the roller's outer circumference; hence, multiple passes are needed to effectively clean the roller. For all the above reasons, the wiping action of these devices is far from optimal.

Another key disadvantage of these devices is that they are not suitable for use with both standard diameter roller and "mini-size" rollers, since the roller-engaging curves in the wire are sized to optimally fit rollers of one diameter only. Marrs's device also exerts different degrees of spring tension, and hence friction, on rollers of different nap thicknesses, so that even different nap thicknesses of the same size roller cannot be wiped uniformly.

Finally, the device of Marrs cannot easily perform the wiping task in the optimal way—that is, wiping in a single pass from the handle end of the roller, down and off the non-handle end of the roller. Either the roller must be removed from its frame (dirtying the hands) to allow single-pass wiping, or the device must be placed on the non-handle end of the roller and wiped downward toward the handle end of the roller. This method of wiping tends to coat the roller handle and frame with paint wiped from the roller, which is not at all satisfactory. Moreover, Marrs's device must then be passed back up the roller to remove it—a cumbersome and unnecessary extra step.

B. Semi-Circular Roller Wipers

U.S. Pat. No. 4,324,018 to Olsson, U.S. Pat. No. 4,982,471 to Bannan, and U.S. Pat. No. 5,546,625 to Mealey, Sr. exemplify this type of roller wiper. These devices also have significant disadvantages.

First, because these devices do not surround a large enough portion of the roller circumference, multiple passes of the tool are necessary to effectively clean the roller.

Second, in operation the user must exert pressure with the tool against the roller while simultaneously moving the tool down the roller. This results in an uneven wiping action, particularly since multiple passes are necessary. It is difficult to exert the same pressure against the roller on each pass, and so a varying, uneven wiping action results.

Third, these devices cannot optimally clean both standard diameter rollers and "mini-size" rollers, since the roller-engaging curve in each device is sized to optimally fit rollers of one diameter only.

C. Fully-Circular Roller Wipers

U.S. Pat. No. 3,707,740 to Demers, U.S. Pat. No. 5,272,782 to Hutt, and U.S. Pat. No. 5,515,567 to Washburn are examples of this type of roller wiper. A key disadvantage of the devices of Hutt, Washburn, and the preferred embodiments (FIGS. 1–3) of Demers, is that they are not suitable for use with both standard diameter roller and "mini-size" rollers, since the roller-engaging aperture is sized to optimally fit rollers of one diameter only. Even different nap thicknesses of the same size roller cannot be handled optimally, since these devices exert different degrees of friction on rollers of different nap thicknesses.

The non-preferred embodiments (FIGS. 4–6) of Demers do provide for adjusting the diameter of the cleaning tool to handle different size rollers; however, the FIGS. 4–5 adjustment methods are cumbersome, time-consuming, and inconvenient to use.

A major drawback of all the embodiments of Demers is that they cannot easily perform the wiping task in the optimal way—that is, wiping in a single pass from the handle end of the roller, down and off the non-handle end of the roller. Either the roller must be removed from its frame (dirtying the hands) to allow single-pass wiping, or the device must be placed on the non-handle end of the roller and wiped downward toward the handle end of the roller. This method of wiping tends to coat the roller handle and frame with paint wiped from the roller, which is not at all satisfactory. Moreover, Demers's embodiments must then be passed back up the roller to remove them—a cumbersome and unnecessary extra step.

A further drawback of the device of Washburn is that it is difficult and time-consuming to place on the roller, and its multiple-piece construction is needlessly complex.

D. spinning-Type Roller Cleaners

U.S. Pat. No. 3,731,697 to Yost and U.S. Pat. No. 5,185,938 to Hutt are illustrative of this type of device, which spins the roller to centrifugally force off paint or solvent. These devices are complex and costly, and since the paint or solvent flies off the roller, they are also messy to use. Further, because these devices do not first wipe the excess paint from the roller, use of these devices does not save paint, nor does it reduce the use of solvent.

These devices also take a long time to remove the paint or solvent from the roller, since the centrifugal force they generate is inadequate to do the job quickly and effectively. In sum, these devices take longer to effectively clean the roller than would a cleaning method which uses my invention to first wipe excess paint from the roller, followed by a simple washing of the roller under a tap.

E. Roller Washers

These devices, shown in U.S. Pat. No. 4,061,153 to Doherty and U.S. Pat. No. 4,606,777 to Brow, spray or otherwise force solvent against the roller to achieve a cleaning action. Like the spinning-type roller cleaners discussed above, these devices are complex, costly, and messy. These devices also do not first wipe the excess paint from the roller; thus, using them will not save paint, nor will it reduce the use of solvent.

These devices also take a long time to remove the paint or solvent, since the excess paint is not first wiped from the roller. As with the spinning-type roller cleaners, these devices take longer to effectively clean the roller than would a cleaning method which uses my invention to first wipe excess paint from the roller, followed by a simple washing of the roller under a tap.

Thus, it can be appreciated that a paint roller cleaning method that uniformly wipes excess paint or solvent from rollers having different diameters and different nap thicknesses, that requires only one pass down the roller to effectively wipe the roller clean, and that can be easily used while the roller is on the roller frame, would be a significant improvement over the prior art.

OBJECTS AND ADVANTAGES

Accordingly, several objects and advantages of my invention are:

My method effectively cleans rollers having different diameters, including the increasingly popular "mini-rollers", and rollers having different nap thicknesses, all in one handy, one-piece tool.

The cleaning aperture almost completely surrounds the outside diameter of the roller, so that only one pass down the roller is required to effectively wipe paint or solvent from the roller.

The method can be used while the roller is on the roller frame, so a user's hands don't get dirty while using the tool.

It's easier to use than prior art methods. A user doesn't have to squeeze the cleaning tool or press it against the roller while drawing it down the roller. In my invention, the frictional wiping action is already "preset" for popular roll diameters and nap thicknesses.

The rigidity of the main body surrounding the cleaning apertures ensures that the cleaning aperture diameters remain fixed as the cleaning tool is drawn down the roller. This increases the stability of the cleaning tool during operation and ensures a uniform wiping action.

It is less messy to operate than prior art methods which spin the roller to centrifugally force off paint or solvent.

After the user selects the appropriate aperture and places the cleaning tool on the roller, the remainder of the main body of the cleaning tool acts as an effective hand grip.

The method minimizes wasted paint, thus also minimizing solvent consumption during the cleaning process.

The cleaning tool itself is easy to clean; paint is easily rinsed from it.

The flat disc shape makes the cleaning tool easy to store. The cleaning tool takes up little room, and unlike some prior art tools, there are no sharp edges which might cut a user's hands. Hence, my cleaning tool can simply be tossed into a painter's tool box without having to consider the risk of injury from upwardly-facing sharp edges.

The cleaning tool can also be used as a roller removal tool, after the roller has been cleaned. To do this, the user simply selects an aperture slightly smaller than that used for cleaning the roller, places this aperture over the roller, and pulls down. The slightly smaller aperture cannot pass over the outside surface of the roller, but instead acts to pull the roller off the frame.

The one-piece construction of one embodiment of the cleaning tool makes it simple to manufacture at a low cost, via plastic injection molding. Some prior art devices constructed of multiple pieces are needlessly complex without being more effective.

Further objects and advantages of my invention will become apparent from a consideration of the drawings and ensuing description.

LIST OF REFERENCE NUMERALS

10. Main body
11*a,b,c&d*. Cleaning apertures
12*a,b,c&d*. Access notches
13. Hanging hole
14*a,b,c,&d*. Handle (alternative embodiment)
15*a,b,c,&d*. Ring opening (alternative embodiment)
16. Ring (alternative embodiment)

SUMMARY

My invention is a paint roller cleaning method that uniformly wipes excess paint or solvent from rollers having different diameters and different nap thicknesses, that requires only one pass down the roller to effectively wipe the roller clean, and that can be easily used while the roller is on the roller frame.

Figure 1:
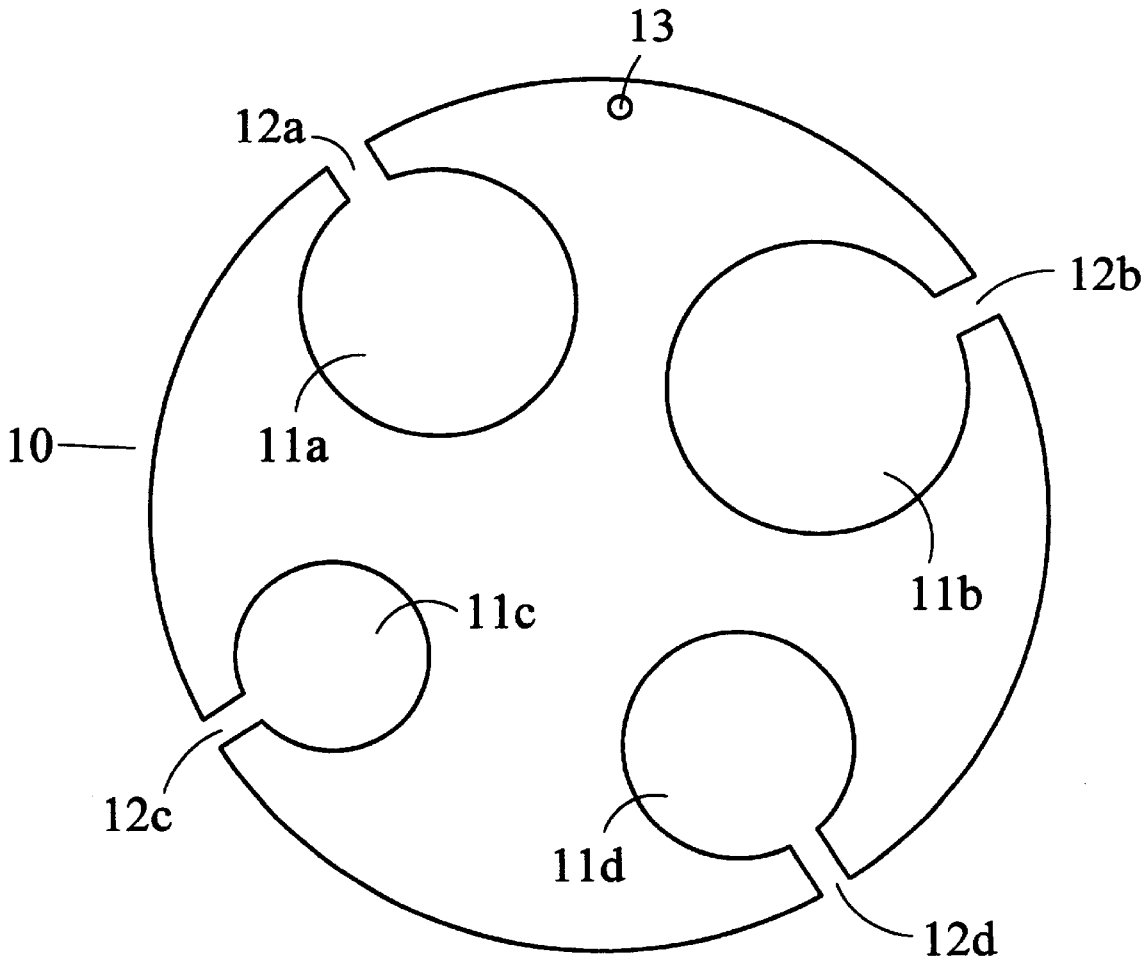
FIG. 1 is a top view of my invention.

Description—Main Embodiment:

As shown in FIG. 1, the cleaning tool comprises a flat, disc-shaped main body 10 having four cleaning apertures 11*a,b,c,&d*.

Cleaning aperture 11*a* has a diameter suitably smaller than the outside diameter, including the nap covering, of a standard-size, smooth-surface roller, such that a friction fit between the nap covering of such a roller and cleaning aperture 11*a* is provided.

Cleaning aperture 11*b* has a diameter suitably smaller than the outside diameter, including the nap covering, of a standard-size, rough-surface roller, such that a friction fit between the nap covering of such a roller and cleaning aperture 11*b* is provided.

Cleaning aperture 11*c* has a diameter suitably smaller than the outside diameter, including the nap covering, of a mini-size, smooth-surface roller, such that a friction fit between the nap covering of such a roller and cleaning aperture 11*c* is provided.

Cleaning aperture 11*d* has a diameter suitably smaller than the outside diameter, including the nap covering, of a mini-size, rough-surface roller, such that a friction fit between the nap covering of such a roller and cleaning aperture 11*d* is provided.

Four access notches 12*a,b,c,&d* extend from the circumferences of cleaning apertures 11*a,b,c,&d* respectively, to the circumference of main body 10. Access notches 12*a,b,c,&d* are of sufficient width such that, when placing the cleaning tool over a roller, the wire portion of the roller handle can pass through one of the access notches 12*a,b,c,* or *d* and be positioned in the center of one of the cleaning apertures 11*a,b,c,* or *d*.

Main body 10 is of sufficient thickness and rigidity to allow the cleaning tool to be drawn down over a snugly fitting roller without bending or flexing unduly. A hanging hole 13, which allows the cleaning tool to be easily hung on a nail for storage, is also located on main body 10.

Operation—Main Embodiment

Figure 2:
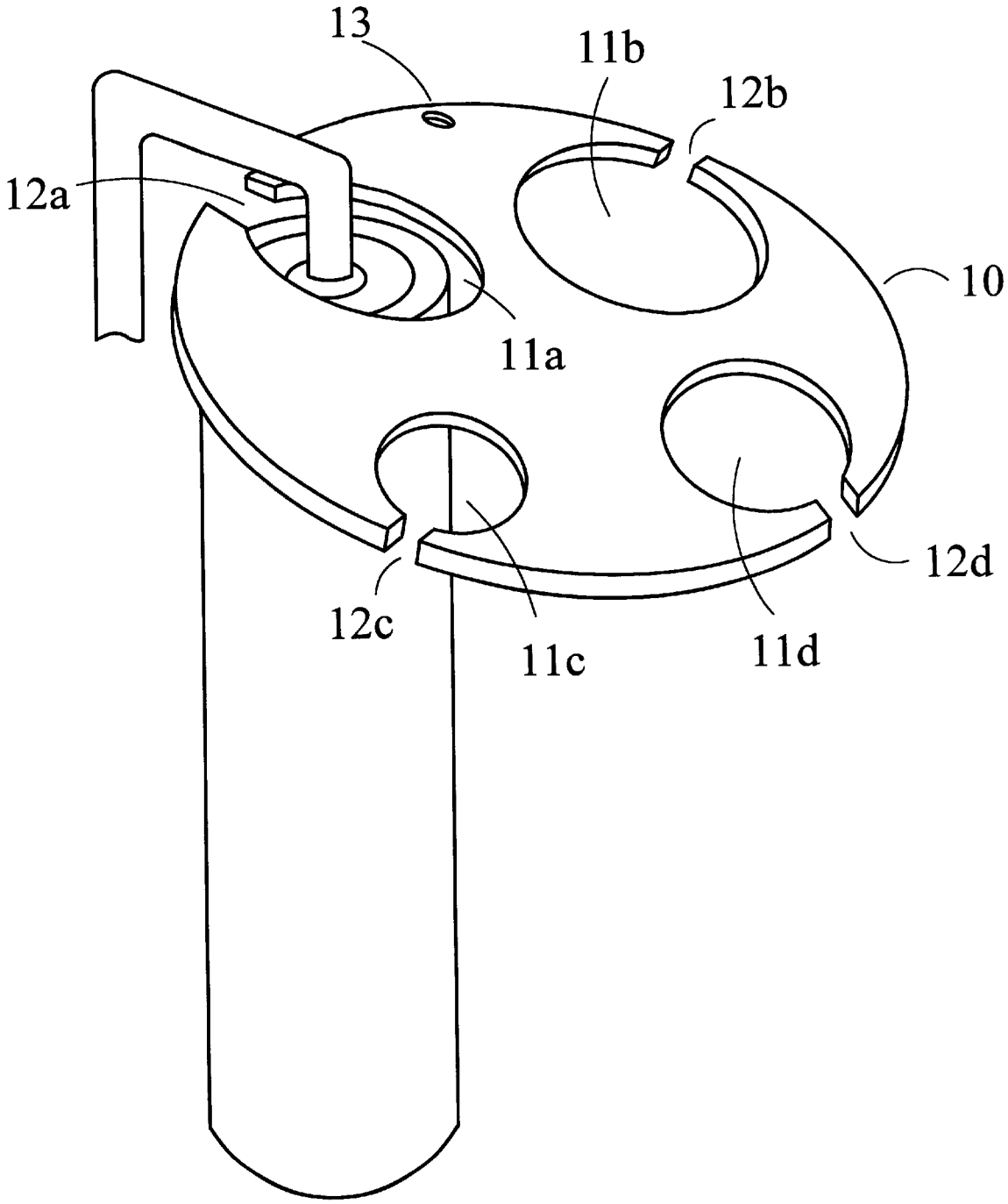
FIG. 2 shows the cleaning tool as it is being placed over the roller at its handle-proximate end.

As shown in FIG. 2, the cleaning tool is placed over the handle end of a roller, with the wire portion of the handle passing through access notch 12*a* and into the center of cleaning aperture 11*a*. The cleaning tool is then drawn down over the nap surface of the roller.

Figure 3:
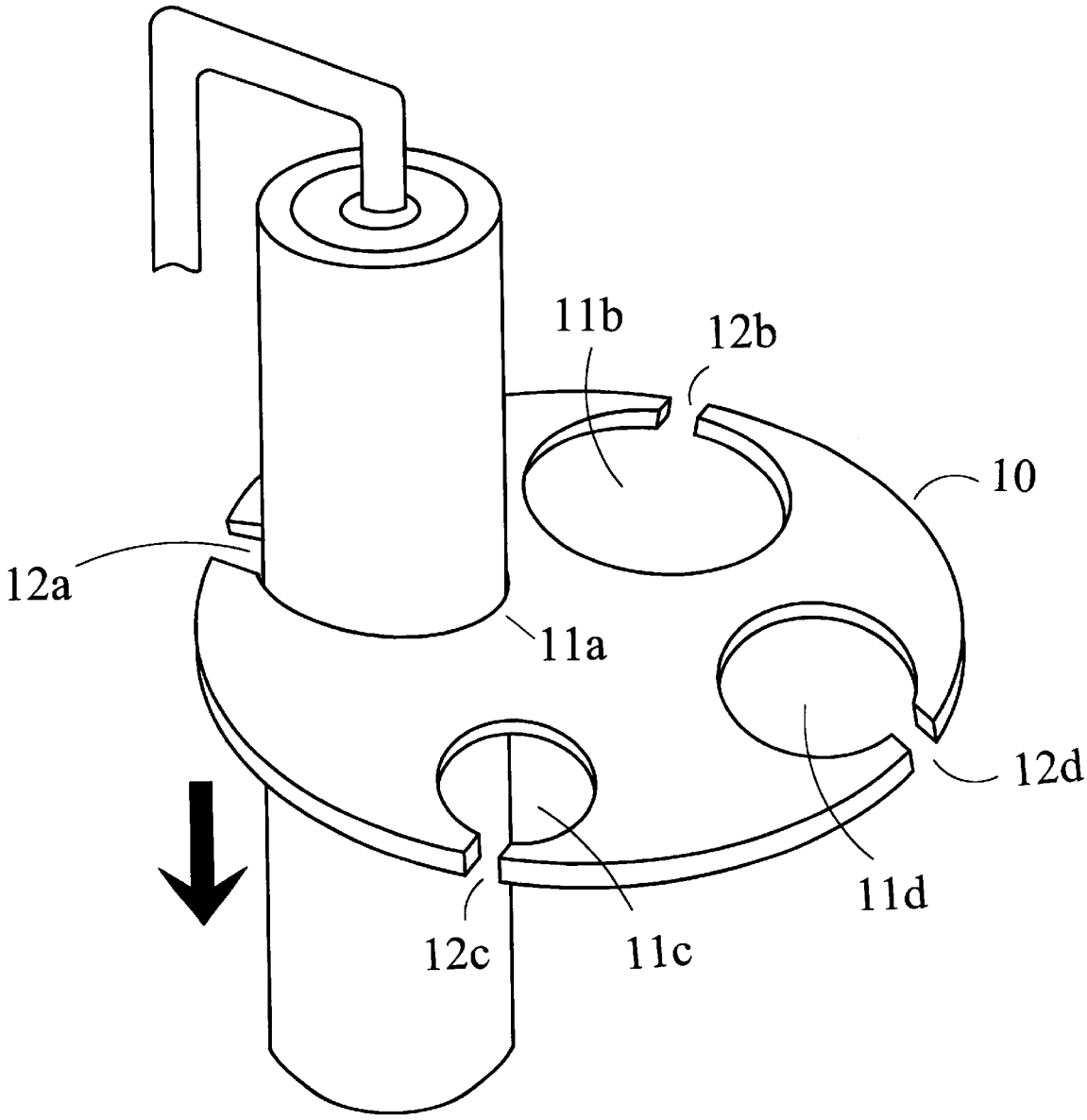
FIG. 3 shows the cleaning tool as it is being drawn down the outside surface of the roller, from the handle-proximate end to the non-handle-proximate end.

As shown in FIG. 3, the friction fit between cleaning aperture 11*a* and the nap surface of the roller acts to wipe paint or solvent from the roller as the cleaning tool is drawn down the roller. The portion of main body 10 surrounding cleaning aperture 11*a* forces the paint or solvent down and off the roller, into a paint can or cleaning receptacle.

Figure 5:
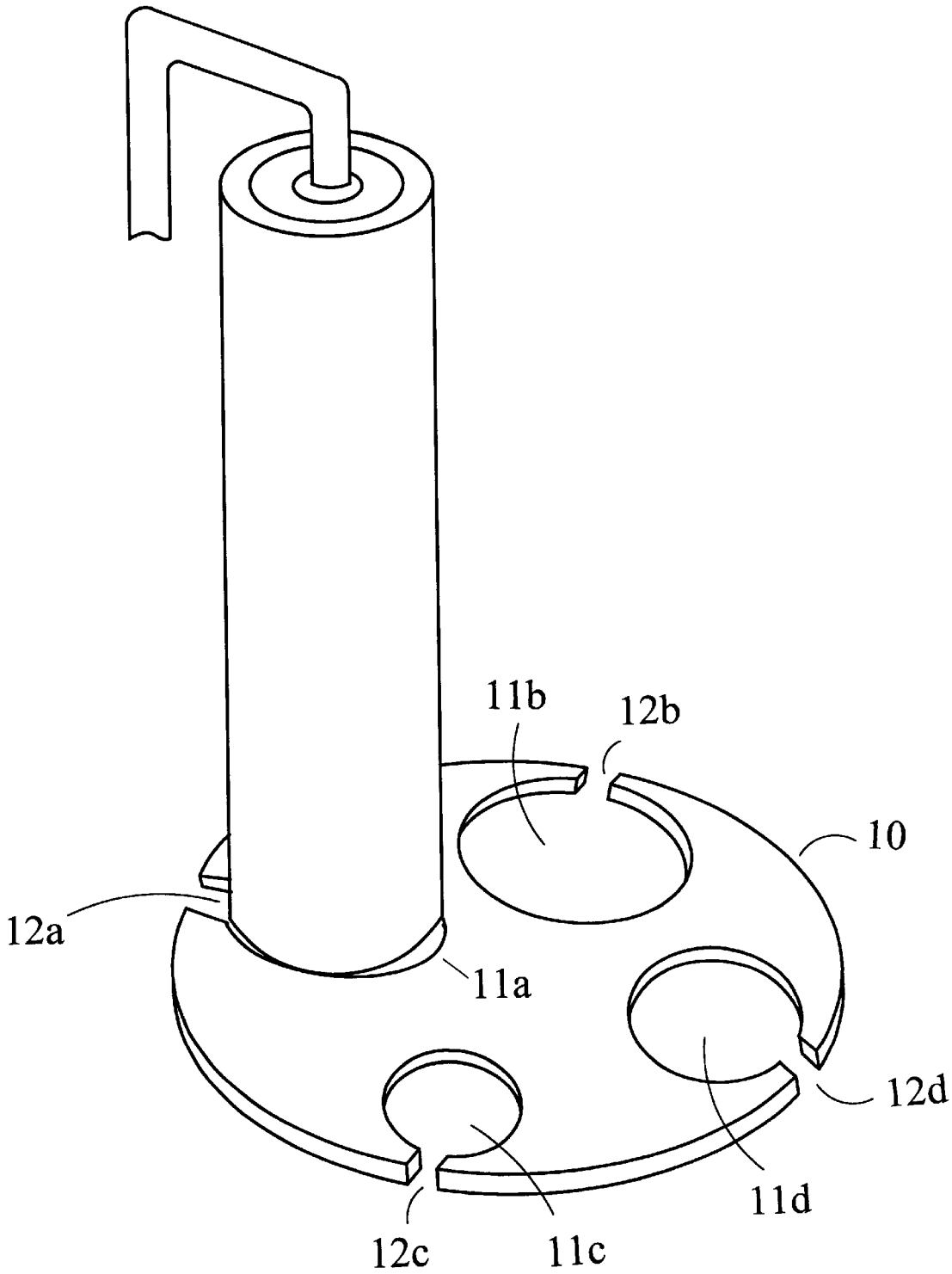
FIG. 5 shows the cleaning tool as it is being placed over the roller at its non-handle-proximate end.
Figure 6:
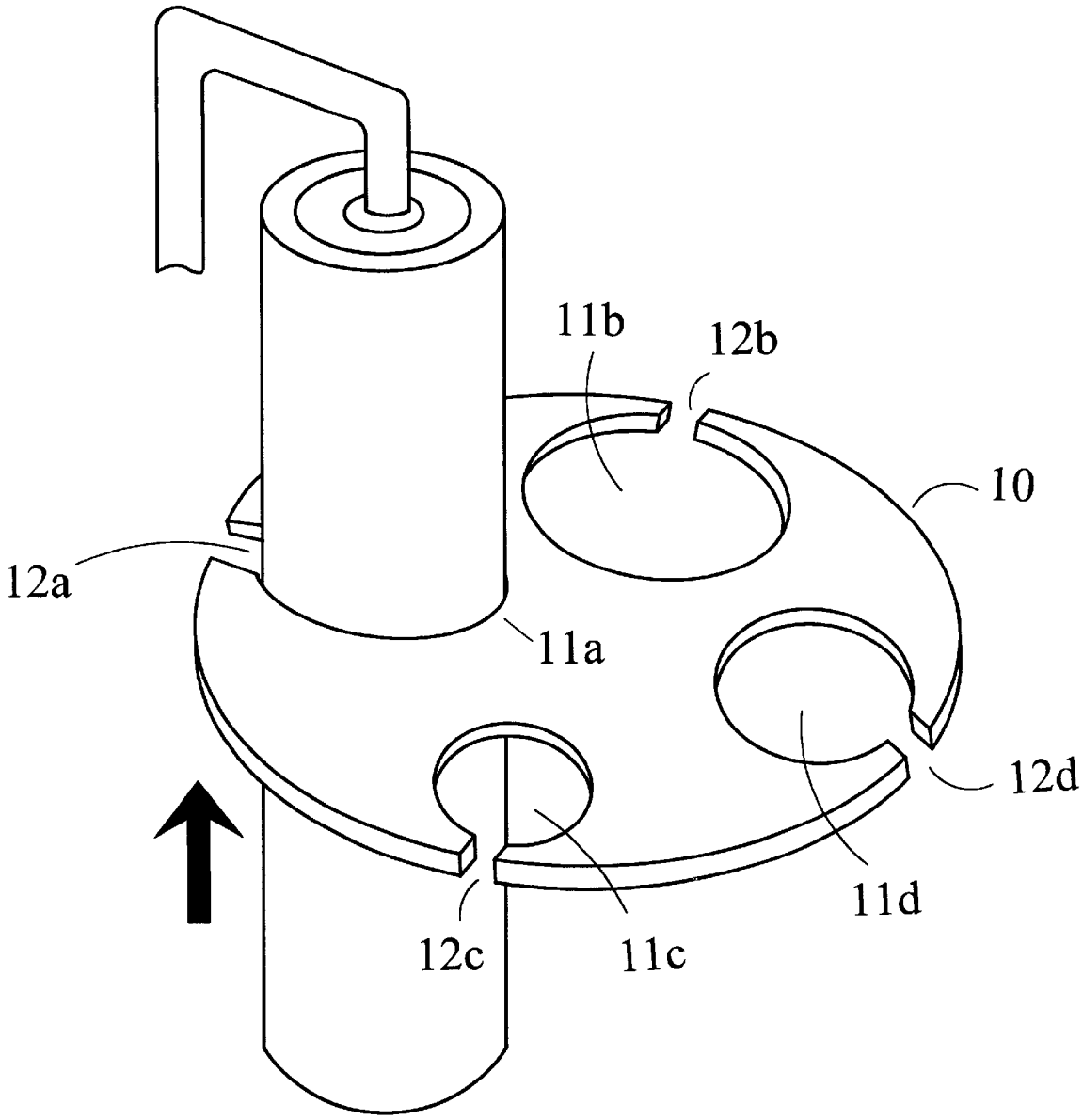
FIG. 6 shows the cleaning tool as it is being drawn up the outside surface of the roller, from the non-handle-proximate end to the handle-proximate end.

It can be appreciated that the cleaning tool can also be placed over the roller at the roller's non-handle-proximate end, drawn up the roller, and then removed from the roller and roller frame at the handle end by withdrawing the wire portion of the handle through access notch 12*a*. (FIGS. 5 and 6 illustrate such an alternative cleaning motion.

Description and Operation—Alternative Embodiment

Figure 4:
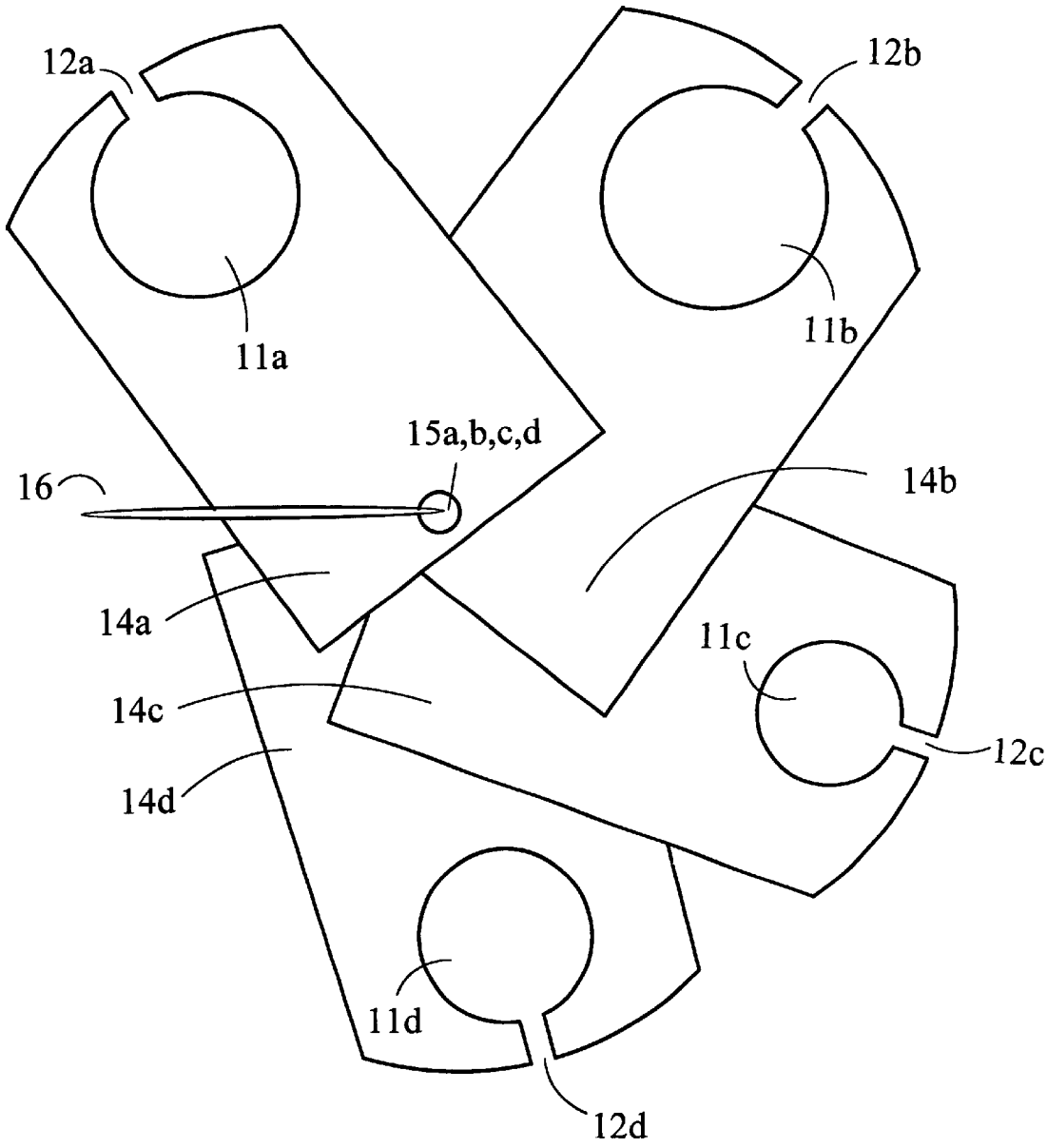
FIG. 4 shows an alternative embodiment—a version with multiple parts attached together to form a multi-part set, each part being suitably sized to clean one of the various popular sizes of rollers.

FIG. 4 illustrates an alternative embodiment—a version with multiple parts attached together to form a multi-part set, each part being suitably sized to clean one of the various popular sizes of rollers. Each part has one cleaning aperture 11*a,b,c,* or *d*, and one access notch 12*a,b,c,* or *d*. As in the main embodiment, each cleaning aperture 11*a,b,c,* or *d* is of a diameter suitable for cleaning a popular size roller. Each part also has a handle 14*a,b,c,* or *d* and a ring opening 15*a,b,c,* or *d* located thereon. A ring 16 projects through ring openings 15*a,b,c,&d*, to attach the parts together in a multi-part set.

This alternative embodiment is operated in the same general manner as the main embodiment.

As with the main embodiment, the alternative embodiment can also be placed over the roller at the roller's non-handle-proximate end, drawn up the roller, and then removed from the roller and roller frame at the handle end by withdrawing the wire portion of the handle through access notch 12*a,b,c,* or *d*.

Conclusions, Ramifications, and Scope

Thus the reader will see that this invention is more effective than prior art methods for cleaning paint or solvent from various-sized rollers, and the cleaning tool is of simple construction and is simple to operate. While my above descriptions contain many specificities, these shall not be construed as limitations on the scope of the invention, but rather as exemplifications of embodiments thereof. Many other variations are possible. For example:

The cleaning tool can have a different number of cleaning apertures, such that more or fewer rollers of different diameters and different nap thicknesses can be accommodated.

The main body shape can be different than the circular disc shape shown in the main embodiment—as examples, it can be square, rectangular, triangular, oval, etc. If square or rectangular in shape, the main body can also be used as a straight edge or ruler.

The thickness of the cleaning tool can be different, as long as sufficient rigidity exists to allow the cleaning tool to be quickly and easily drawn down the roller.

The access notches can be of a different length than that shown in the main embodiment, and the cleaning apertures can correspondingly have different degrees of proximity to the circumference of the main body.

The access notches can be of a different width than that shown in the main embodiment; although at a minimum, the access notches must be wide enough to permit the wire portion of the roller handle to pass through them.

The hanging hole can be eliminated.

Supplementary roller-wiping curves can be incorporated into the circumference of the cleaning tool, between the primary cleaning apertures, to facilitate cleaning a roller of unusual size or nap thickness.

The cleaning apertures can be located on insertable and removable sections of the main body, such that a cleaning aperture could be removed, and one of a different diameter inserted.

The cleaning tool can be used to clean any cylindrical roller which applies liquid coatings, not just paint rollers.

In the alternative embodiment of FIG. 4, the method by which the parts are attached together to form a multi-part set can be different. As just one example, the parts may be stacked and held together with a pin.

In the alternative embodiment of FIG. 4, the handle can be eliminated if there is sufficient area surrounding the cleaning aperture to provide a suitable hand grip.

The cleaning tool may be formed from many different materials.

Accordingly, the scope of the invention should be determined not by the embodiments illustrated, but by the appended claims and their legal equivalents.

I claim:

1. A method of cleaning a liquid coating applying roller, comprising:

a) providing a cleaning tool comprising:
(i) a main body, and
(ii) a plurality of cleaning apertures located on said main body, said cleaning apertures being sized to frictionally engage rollers of different diameters, and
(iii) a plurality of access notches located on said main body between the circumferences of said cleaning apertures and the perimeter of said main body, b) placing one said cleaning aperture of said cleaning tool over the handle-proximate end of said roller when said roller is on a roller frame, by passing a portion of said roller frame through one of said access notches, and c) drawing said cleaning tool from the handle-proximate end to the non-handle-proximate end of said roller, thereby wiping excess coating or solvent from said roller.

2. The method of claim 1, wherein said main body is relatively thin, and has a circular disc shape.

3. The method of claim 1, wherein said main body has four said cleaning apertures located thereon.

4. The method of claim 1, wherein said main body has four said access notches located thereon.

5. The method of claim 1, wherein a hanging hole, suitable for hanging said tool on a nail or similar projection, is located on said main body.

6. A method of cleaning a liquid coating applying roller, comprising:

a) providing a cleaning tool comprising:
(i) a main body, and
(ii) at least one cleaning aperture located on said main body, said cleaning aperture being sized to frictionally engage a roller of predetermined diameter, and
(iii) at least one access notch located on said main body between the circumference of said cleaning aperture and the perimeter of said main body, b) placing said cleaning aperture of said cleaning tool over the handle-proximate end of said roller when said roller is on a roller frame, by passing a portion of said roller frame through said access notch, and c) drawing said cleaning tool from the handle-proximate end to the non-handle-proximate end of said roller, thereby wiping excess coating or solvent from said roller.

7. The method of claim 6, wherein said main body is relatively thin, and has a circular disc shape.

8. The method of claim 6, wherein said main body is relatively thin, and has a rectangular plane shape.

9. The method of claim 6, wherein said main body has four said cleaning apertures located thereon.

10. The method of claim 6, wherein said main body has four said access notches located thereon.

11. The method of claim 6, wherein a hanging hole, suitable for hanging said tool on a nail or similar projection, is located on said main body.

12. A method of cleaning for a liquid coating applying roller, comprising:

a) providing a cleaning tool comprising:

(i) a plurality of main parts, and (ii) connecting means to attach together said main parts, and (iii) a cleaning aperture located on each of said main parts, said cleaning aperture being sized to frictionally engage a roller of predetermined diameter, and (iv) an access notch located on each of said main parts between the circumference of said cleaning aperture and the perimeter of said main body, b) placing said cleaning aperture of said cleaning tool over the handle-proximate end of said roller when said roller is on a roller frame, by passing a portion of said roller frame through said access notch, and c) drawing said cleaning tool from the handle-proximate end to the non-handle-proximate end of said roller, thereby wiping excess coating or solvent from said roller.

13. The method of claim 12, wherein each of said main parts is relatively thin, and has a rectangular plane shape.

14. The method of claim 12, wherein said connecting means comprise a ring projecting through a ring opening located on each of said main parts.

15. A method of cleaning a liquid coating applying roller, comprising:

a) providing a cleaning tool comprising:

(i) a main body, and (ii) at least one cleaning aperture located on said main body, said cleaning aperture being sized to frictionally engage a roller of predetermined diameter, and (iii) at least one access notch located on said main body between the circumference of said cleaning aperture and the perimeter of said main body, b) placing said cleaning aperture of said cleaning tool over the non-handle-proximate end of said roller when said roller is on a roller frame, and c) drawing said cleaning tool from the non-handle-proximate end to the handle-proximate end of said roller, and d) removing said cleaning tool from said roller by withdrawing a portion of said roller frame through said access notch, thereby wiping excess coating or solvent from said roller.

16. The method of claim 15, wherein said main body is relatively thin, and has a circular disc shape.

17. The method of claim 15, wherein said main body is relatively thin, and has a rectangular plane shape.

18. The method of claim 15, wherein said main body has four said cleaning apertures located thereon.

19. The method of claim 15, wherein said main body has four said access notches located thereon.

20. The method of claim 15, wherein a hanging hole, suitable for hanging said tool on a nail or similar projection, is located on said main body.

* * * * *